US006957699B2

(12) United States Patent
Feluch et al.

(10) Patent No.: US 6,957,699 B2
(45) Date of Patent: Oct. 25, 2005

(54) DOWNHOLE SHUT-IN TOOL

(75) Inventors: Paul John Feluch, Okotoks (CA); Boris Timoffee, Calgary (CA)

(73) Assignee: Stellar Tech Energy Services Inc., Calgary (CA)

( * ) Notice: Subject to any disclaimer, the term of this patent is extended or adjusted under 35 U.S.C. 154(b) by 2 days.

(21) Appl. No.: 10/435,262

(22) Filed: May 12, 2003

(65) Prior Publication Data

US 2004/0226721 A1 Nov. 18, 2004

(51) Int. Cl.[7] ..... E21B 34/06
(52) U.S. Cl. ..... 166/184; 166/334.1
(58) Field of Search ..... 166/184, 185, 166/332.1, 324.1, 64, 66.4

(56) References Cited

U.S. PATENT DOCUMENTS 3,381,751 A * 5/1968 McLelland ..... 166/66.4
4,140,153 A 2/1979 Deaton
4,274,486 A 6/1981 Fredd
4,345,648 A 8/1982 Kuus
4,420,045 A 12/1983 McMahan
4,470,465 A * 9/1984 Zimmerman et al. .... 166/332.3
4,475,599 A 10/1984 Akkerman
4,804,042 A * 2/1989 Knight et al. ..... 166/184
4,964,460 A 10/1990 Armell et al.
4,986,357 A 1/1991 Pringle
5,188,172 A * 2/1993 Blount et al. ..... 166/64
5,234,057 A * 8/1993 Schultz et al. ..... 166/319
5,332,035 A 7/1994 Schultz et al.
5,375,658 A 12/1994 Schultz et al.

* cited by examiner

*Primary Examiner*—William Neuder

(57) ABSTRACT

The invention provides a downhole shut-in tool for obtaining formation pressure data. The tool includes a fast-closing main valve and a pressure-relief valve operable between open and closed positions to effect periodic sealing and release of formation pressure with respect to the surface.

19 Claims, 4 Drawing Sheets

DOWNHOLE SHUT-IN TOOL

FIELD OF THE INVENTION

The invention provides a downhole shut-in tool for obtaining formation pressure data. The tool includes a fast-closing main valve and a pressure-relief valve operable between open and closed positions to effect periodic sealing and release of formation pressure with respect to the surface.

BACKGROUND OF THE INVENTION

In the oil industry, shut-in tools are used downhole to provide downhole shut-in of the well so that various parameters of the downhole conditions such as pressure, temperature and flow from producing sections of the well can be measured more accurately. The shut-in tool is lowered into a gas or oil well with a slick-line truck and set and sealed with packing into a profile in the tubing in order that flow from the formation is directed through the shut-in tool.

A shut-in tool generally includes a valve system, a motor, a battery and microprocessor that enable the flow through the tool and hence, from the well, to be halted periodically such that downhole data from the producing zone can be measured and recorded. That is, the valve assembly is periodically closed thus sealing the producing zone from the surface in order that pressure and temperature profile of the producing zone can be recorded by recording sensors attached to the tool. After the desired amount of data has been collected, the valve assembly is opened and flow is again directed through the tool. The tool and recording sensors are periodically returned to the surface and the data is downloaded to allow engineers and geologists to both measure and predict the present and on-going production characteristics of the producing zone.

More specifically, in operation the valve is opened and closed by the motor in response to instructions from the microprocessor. The shut-in tool is normally programmed at the surface to set the desired open and close times for the valve, the specific times for opening and closing and the times between opening and closing depending on the specific information desired from the formation and the characteristics of the formation.

It is preferable that shut-in tools have fast reacting valves in order that the pressure readings immediately following valve closure are accurate. In the past, low closing valves (often requiring 2–3 minutes for closure) require that the data obtained be subjected to various mathematical compensation algorithms in order to compensate for the distortions in data during valve closure. While such algorithms may be partially effective in predicting instantaneous pressure build-up, these compensation techniques are subject to errors and, accordingly, there is a need for tools that have instantaneous or near-instantaneous valve closures in order that true instantaneous pressure data can be obtained.

Furthermore, as significant pressures may exist across the valve while the valve is closed (5000 psi), there is also a need for shut-in tools having an effective pressure equalization system that allows the pressure across the valve to be equalized prior to opening the valve.

It is also desirable that the tools have the necessary reliability and, in particular, be manufactured from abrasion resistant materials at the sealing surfaces to ensure effective sealing under abrasive conditions.

A review of the prior art reveals U.S. Pat. No. 5,332,035 U.S. Pat. No. 5,375,658, which describes a shut in tool having a piston.

SUMMARY OF THE INVENTION

The invention provides a shut-in tool for setting and sealing within downhole tubing above a producing formation such that the shut-in tool controls the flow of fluids from the formation for the purpose of collecting data from the formation that may be used for evaluating the production capabilities of the formation.

In one main embodiment, the shut-in tool comprises a main valve assembly operably retained within a housing, the main valve assembly including a main valve operable between a loaded open position allowing fluid flow from the exterior of the housing through the housing and a closed position that prevents fluid flow from the exterior of the housing through the housing wherein the main valve is triggerable to effect immediate closure of the main valve.

In further embodiments, the tool includes an actuation system for actuating the main valve between the loaded open position and the closed position and more specifically for triggering movement of the main valve from the loaded open position to the closed position.

In another embodiment, the shut-in tool also includes a pressure relief valve within the housing for equalizing the pressure across the main valve prior to opening the main valve. The pressure relief valve is operable between a relief valve open position allowing fluid flow from the exterior of the housing through the housing and a relief valve closed position that prevents fluid flow from the exterior of the housing through the housing and may also be under the control of the actuation system.

The actuation system preferably includes a linearly displaceable pull rod within the housing to effect opening of the main valve and triggering of the main valve to the closed position.

In a preferred embodiment, the main valve includes a ball linearly displaceable within the housing between a sealing surface and the loaded open position and wherein the ball is biased towards the sealing surface. The system may also include a push tube for engagement with the ball and a collet for releasably securing the push tube in the loaded position with the main valve open. In one embodiment, the push tube includes at least one lock orifice and a drive slot operatively connected to the pull rod wherein linear movement of the pull rod with respect to the push tube in a first direction advances the push tube with respect to the collet to engage the collet with the at least one lock orifice for releasably securing the main valve in the loaded position. Linear movement of the pull rod in a second direction disengages the collet from the at least one lock orifice to effect immediate closure of the main valve.

In still further embodiments, the pressure relief system includes a relief ball linearly displaceable within the housing between a relief sealing surface and the relief-valve open position and wherein the relief ball is biased towards the relief sealing surface. In embodiments where the actuation system includes a pull rod, the pull rod may be provided with first and second flat surfaces and first and second tapered surfaces and wherein the pressure relief system includes a relief valve stem biased against the first and second flat and first and second tapered surfaces. In these embodiments, engagement of the relief valve stem against the first and second flat surfaces maintains the pressure relief valve in a closed position and engagement of the relief valve stem against the first and second tapered surfaces maintains the pressure relief valve in the open position.

It is also preferred that the actuation system is operatively connected to a microprocessor for controlling the times of opening and closing the main valve and pressure relief valve. In further embodiments, the tool may further include at least one pressure sensor operatively connected to the microprocessor wherein the microprocessor controls the opening and closing of the main valve and pressure relief valve in response to downhole conditions. In one embodiment, the microprocessor is responsive to pressure pulses from the surface for opening and closing the main valve and pressure relief valve.

In a more specific embodiment, the invention provides a shut in tool for setting and sealing within downhole tubing above a producing formation and for collecting data from the formation, comprising a housing having an interior and exterior; a main valve assembly within the housing having a main valve, the main valve operable between a loaded open position allowing fluid flow from the exterior of the housing through the housing and a closed position that prevents fluid flow from the exterior of the housing through the housing wherein movement from the loaded open position to the closed position is immediate upon triggering; a pressure relief valve within the housing, the pressure relief valve operable between a relief valve open position allowing fluid flow from the exterior of the housing through the housing and a relief valve closed position that prevents fluid flow from the exterior of the housing through the housing; and an actuation system for actuating the main valve assembly between the loaded open position and the closed position wherein the actuation system triggers movement of the main valve from the loaded open position to the closed position, the actuation system also for actuating the pressure relief valve between the relief valve open and relief valve closed positions.

BRIEF DESCRIPTION OF THE DRAWINGS

The invention is described with reference to the following drawings wherein.

DETAILED DESCRIPTION OF THE INVENTION

With reference to the Figures, a ball-valve shut-in tool is described.

Figure 1:
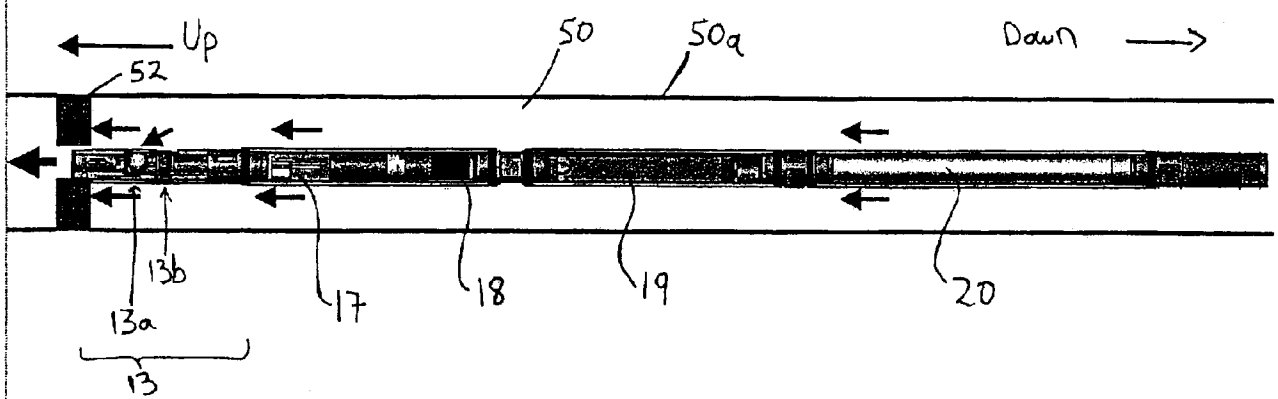
FIG. 1 is a schematic side view of a ball-valve shut-in accordance with the invention.

FIG. 1 shows an overall assembly of a ball-valve shut-in tool 100 in accordance with the invention set inside an oil or gas well 50. As shown, the shut-in tool is positioned downhole above a producing formation and is sealed beneath packing material 52 such that flow from the formation to the surface is through the shut-in tool as shown by the flow arrows. The shut-in tool generally includes (as shown from top to bottom, where top is the direction of the surface) a valve assembly 13 (including a main valve assembly 13*a* and a pressure relief valve assembly 13*b*), which is operatively connected to a screw-drive 17, an electric motor 18, a microprocessor 19 and a battery 20. The assembled tool 100 also includes pressure/temperature sensors attached to the bottom end of the tool (not shown) that either communicate with the microprocessor or operate independently of the microprocessor.

Figure 2:
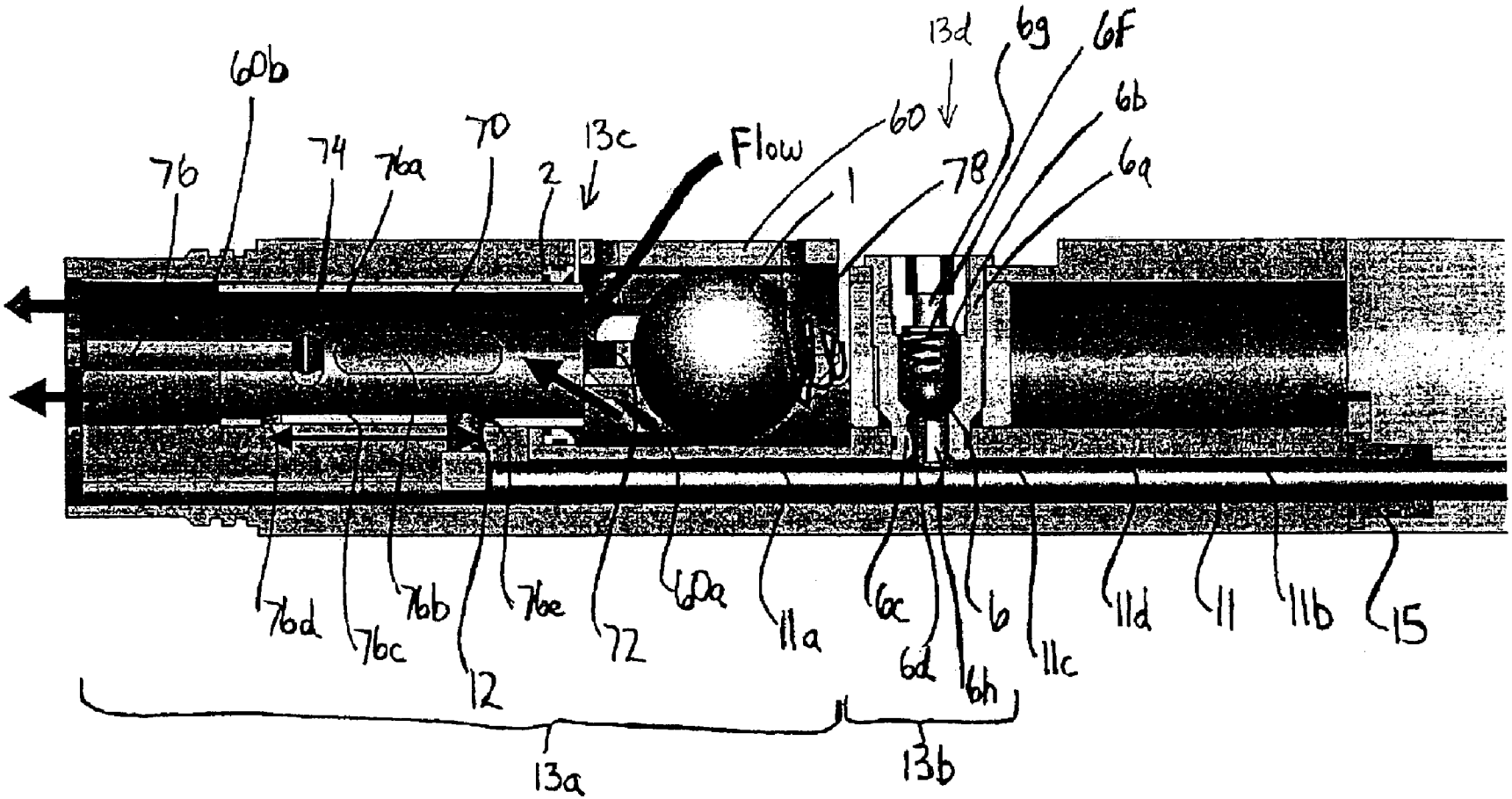
FIG. 2 is cut-away side view of the valve assembly in the open position in accordance with one embodiment of the invention.
Figure 3:
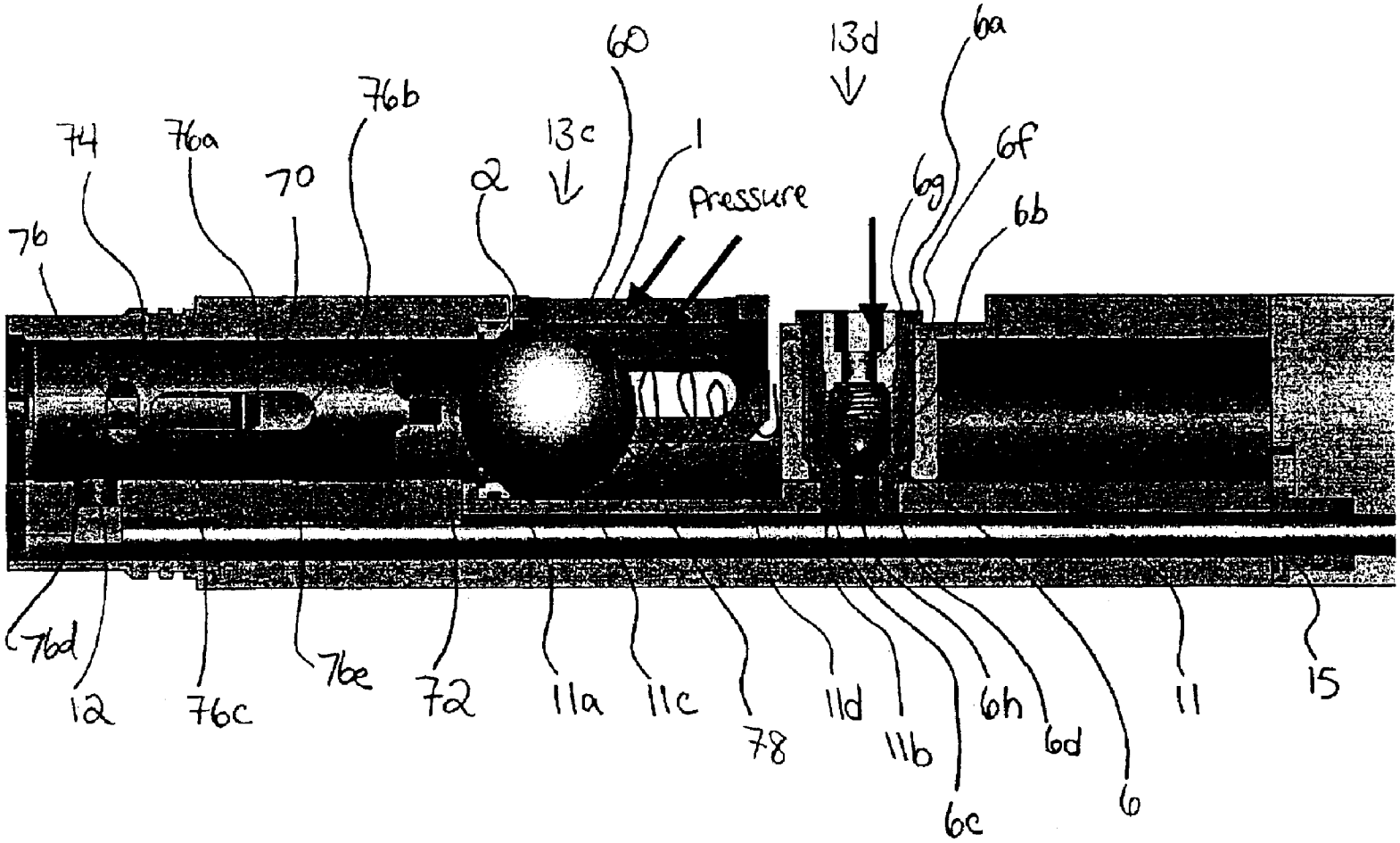
FIG. 3 is cut-away side view of the valve assembly in the closed position in accordance with one embodiment of the invention.
Figure 4:
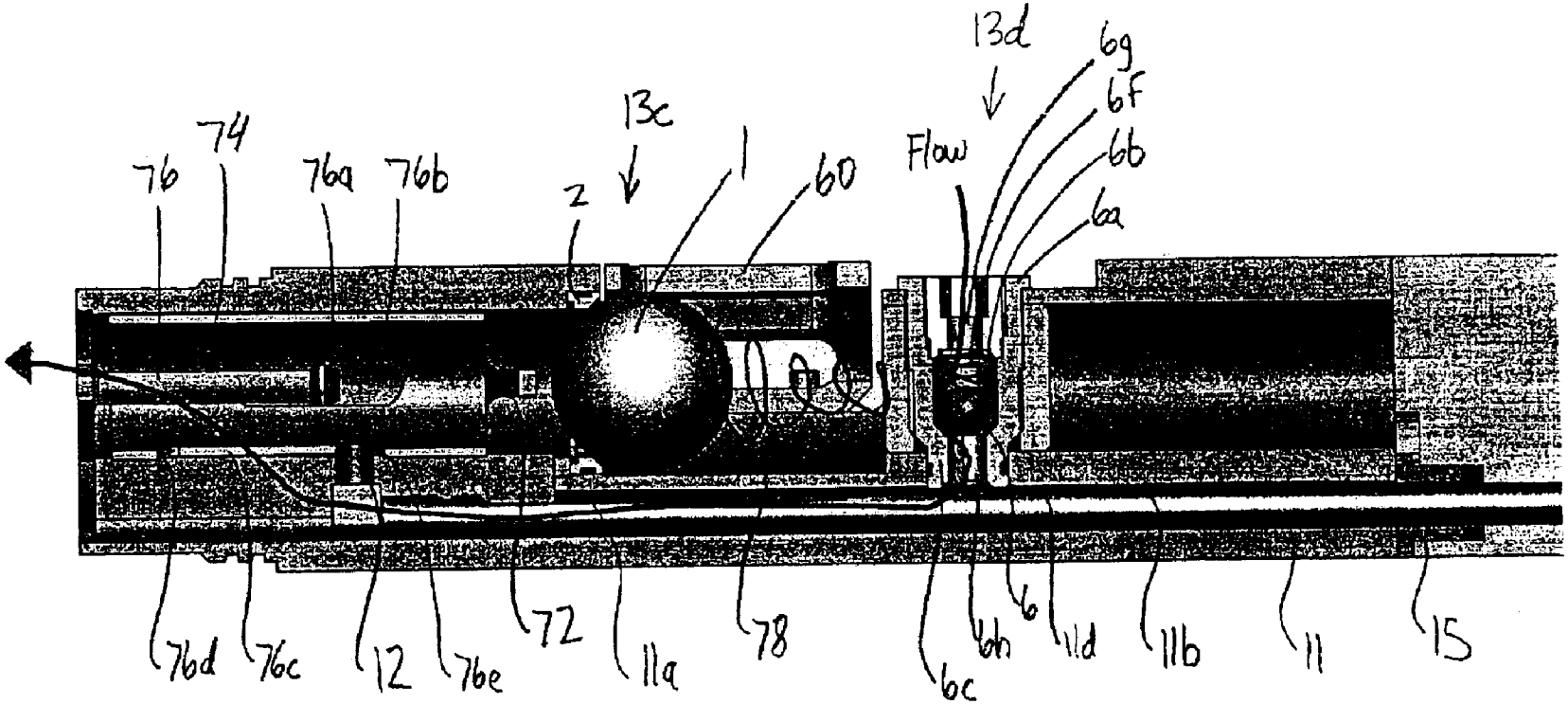
FIG. 4 is cut-away side view of the valve assembly in the equalized position in accordance with one embodiment of the invention.

The valve assembly, including main valve 13*c* is shown in greater detail in FIGS. 2, 3 and 4 in open, closed and equalizing positions respectively. In the open position (FIG. 2), the main valve 13*c* is open to allow the flow of hydrocarbons through the shut-in tool to the surface. In the closed position (FIG. 3), the main valve is closed to prevent the flow of hydrocarbons to the surface. In the equalizing position (FIG. 4), the pressure relief valve 13*d* is opened to permit limited flow of hydrocarbon from the formation through the tool in order to equalize pressure on both sides of the main valve to permit opening of the main valve.

Main Valve and Pressure Relief Valve Assemblies

The opening and closing of the main valve 13*c* and pressure relief valve 13*d* is controlled by the linear position of pull rod 11. The linear position of the pull rod is controlled by the screw drive 17.

The main valve assembly includes a large diameter ball 1 retained within a housing 60 having a number of vents 60*a* for allowing the flow of fluids from the exterior of the housing through the interior 60*b* of the tool. The large diameter ball is linearly displaceable within the housing between an upper position (FIG. 3) where the ball 1 abuts and seals against a seal 2 to prevent flow of fluid in through the housing and a lower position (FIG. 2) where the ball is pushed away from the seal 2 to allow the flow of fluid through the housing and up through the tool. The housing further retains a push tube 70 also linearly displaceable within the housing for biasing the large diameter ball between the upper and lower positions. The push tube includes a centrally located stem 72 at the lower end for contacting the large ball and applying an axial pressure to the large ball within the housing whilst permitting fluid flow around the outside of the stem.

The push tube further includes collet lock orifices 74 for engagement with a collet 76 having collet heads 76*a*. The collet and collet lock orifices operate to secure the push tube in the lower position thereby securing the large diameter ball in the open position.

The push tube also includes collet slots 76*b* separated from and aligned with the collet heads for receiving the collet heads as the push tube moves from the lower to the upper position thereby permitting axial movement of the push tube in the housing.

Further still, the push tube includes a drive slot 76*c* for operative engagement with the pull rod via a lug 12 wherein linear movement of the pull rod causes linear movement of the lug within the drive slot between an upper and lower position. In the upper position (FIG. 3), the lug pushes the push tube to the upper position where the collet heads are engaged with the collet slots and the central stem 72 is retracted from the large ball. In this position, large ball spring 78 biases the large ball against the seal thereby sealing the exterior of the tool from the interior.

In the lower position (FIG. 2), the lug pulls the push tube to the lower position such that the collet heads are engaged with the collet lock orifices and the central stem is engaged against the large diameter ball thus placing the main valve assembly in the open position. Importantly, as the collet heads are engaged in the collet lock orifices, the large ball is held in the open position until the lug engages with the upper edge 76*d* of the drive slot. As the lug engages with the upper edge of the drive slot, the collet heads are urged from the collet lock orifices into the collet slots thus causing immediate closure of the valve under the biasing force of the large ball spring. That is, as the collet heads move into the collet slots, the large ball spring acting on the large ball pushes the push tube to the upper position wherein the large ball engages with the tapered seal thereby closing the main valve assembly.

The pressure relief valve assembly 13*b* operates to equalize pressure on both sides of the main valve assembly to enable the main valve assembly to be opened when there would otherwise be a significant pressure differential across the main valve that would prevent the motor and screw drive from opening the main valve.

As shown in FIGS. 2, 3 and 4, a small diameter or relief ball 6 is retained within a relief valve chamber 6*a* operatively attached to the main housing 60*a*. The small valve chamber includes a main chamber 6*b* and neck region 6*c* defining a sealing surface 6*d* between the main chamber and neck region. The relief valve chamber further includes a relief spring 6*f*, the relief spring being set between a set-screw 6*g* and the relief ball wherein the relief spring biases the relief ball towards the sealing surface. The pressure relief valve assembly further includes a relief stem 6*h* within the neck region that is operable between an open position where it contacts the relief ball and biases the relief ball away from the sealing surface and a closed position where the relief ball is biased against the sealing surface. The linear position of the relief stem within the neck region is controlled by the linear position of the pull rod. As shown in FIGS. 2, 3 and 4, the pull rod includes flat 11*a*, 11*b* and tapered 11*c*, 11*d* surfaces against which the relief stem is biased by the relief spring.

As shown in FIG. 2, when the pull rod is in the lower position (and the main valve is opened), the relief stem is biased against a first flat surface 11*a* wherein the relief spring sets the relief ball against the sealing surface. Upon upward movement of the pull rod, as shown in FIG. 4, the relief stem is biased to the open position by tapered surface 11*c* thereby opening the pressure relief valve. At this position, the main valve may be open or closed depending upon whether the main valve had been previously set to the open position. Further upward movement of the pull rod causes the relief stem to be biased against a second flat surface 11*b* wherein the pressure relief valve returns to a closed position. The relief stem moves to this closed position simultaneously with the triggering of the main valve assembly to the closed position.

Accordingly, the following sequence of events takes place from the lower position of the pull rod through to the upper position of the pull rod:

a) At the lower position, the main valve is set to the open position by the engagement of the collet heads with the lock orifices and the relief valve is closed. Fluid flow is through the main valve.

b) Upward movement of the pull rod causes the lug to advance upwardly through the drive slot. The main valve remains open and the pressure relief valve is opened and closed as the relief stem passes over tapered surfaces 11*c* and 11*d*. Fluid flow is through the main valve and briefly through the relief valve c) At the upper position, the tug contacts the upper edge of the drive slot and triggers the main valve to close. The pressure relief valve is closed at this position. There is no fluid flow through the tool.

d) Initial downward movement of the pull rod causes the pressure relief valve to open. Fluid flow is through the pressure relief valve only causing an equalizing of pressure on both sides of the main valve.

e) Continued downward movement of the pull rod causes the lug 12 to contact the lower edge 76*e* of the drive slot 76*c* which causes the push stem to move down and cause push tube stem to contact the large diameter valve and open the main valve. The relief valve is closed. Fluid flow is through the main valve.

f) Continued downward movement of the pull rod causes the collet heads to engage with the collet lock orifices and set the main valve in the open position. The relief valve is closed. Fluid flow is through the main valve.

Motor Assembly

The motor assembly includes an electric motor and drive mechanism for linear actuation of the pull rod. The drive mechanism is preferably a screw drive mechanism 17 with appropriate gearing to provide desired rates of travel and torque characteristics to the pull rod. The pull rod is sealed from the drive mechanism by seal The electric motor 18 is operatively connected to the microcontroller and the battery.

Microcontroller

The microcontroller 19 controls the movement of the pull rod and, hence, the opening and closing of the tool. Opening and closing may be in accordance with pre-set times or in response to specific downhole conditions. The microcontroller includes an internal clock from which the times of opening and closures are measured. Typically, the internal clock is zeroed at the surface and specific opening and closures programmed to occur at specific times thereafter. In another embodiment, the opening and closing of the tool is determined in response to specific downhole conditions such as a maximum pressure condition. In this embodiment, the tool may include an appropriate pressure sensor(s) (not shown) to determine when a maximum pressure, or threshold pressure condition (such as a threshold rate of change of pressure condition), is reached in order to open the main valve. This embodiment would be effective in minimizing the amount of time that the main valve is closed to reduce the time-lost producing the well.

In another embodiment, the shut-in tool may include a pressure sensor (not shown) responsive to pressure pulses from the surface to effect immediate opening, closure, equalization or a delay in opening or closure of the tool. For example, the microprocessor (in conjunction with a pressure sensor on the uphole side of the main valve) can be programmed to receive pressure pulses initiated from the surface at specific timed intervals. The time intervals between pressure pulses can be used to represent specific commands to the tool. For example, a three-pulse signal at a particular threshold received in a fixed time interval and with a specific time between the first and second and second and third pulses may be programmed to represent a command to immediately close the valve.

The tool may also include pressure sensors (not shown) on the upper and lower sides of the main valve with appropriate interfacing and programming with the microprocessor to ensure that the pressure on either side of the tool is fully equalized before the motor is instructed to open the main valve.

The tool may also include torque sensors (not shown) to ensure that excessive torque thresholds are not passed when attempting to open the main valve.

Battery Assembly

The battery assembly includes a battery pack as is known to one skilled in the art to provide sufficient power requirements to the motor.

Pressure/Temperature Recording

The tool is also adapted for holding pressure and temperature recorders for recording pressure and temperature conditions downhole. Other sensors as may be appropriate may be attached to the tool.

Operation

In operation, the shut-in tool is programmed for downhole testing of a formation in accordance with the particular formation characteristics or data requirements over a specific test period (typically ranging from 7–30 days). The tool is lowered by a slick line to the appropriate position above the formation and set within a tubing profile 50*a* with appropriate packing material 52. The well is then returned to production with programmed interruptions as per the tool programming to collect formation data. After completion of the programmed data collection, the tool is returned to surface and the data downloaded for analysis.

What is claimed is:

1. A shut-in tool for setting and sealing within downhole tubing above a producing formation, the shut-in tool for controlling the flow of fluids from the formation and for collecting data from the formation from at least one data collection system operatively connected to the shut-in tool, the shut-in tool comprising:

a main valve assembly operably retained within a housing, the main valve assembly including a main valve operable between a loaded open position allowing fluid flow from the exterior of the housing through the housing and a closed position that prevents fluid flow from the exterior of the housing through the housing wherein the main valve is triggerable to effect immediate closure of the main valve, the main valve having a ball linearly displaceable within the housing between a sealing surface when in the closed position and the loaded open position and wherein the ball is biased towards the sealing surface.

2. A shut-in tool as in claim 1 further comprising an actuation system for actuating the main valve between the loaded open position and the closed position and wherein the actuation system triggers movement of the main valve from the loaded open position to the closed position.

3. A shut-in tool as in claim 1 further comprising a pressure relief valve within the housing, the pressure relief valve operable between a relief valve open position allowing fluid flow from the exterior of the housing through the housing and a relief valve closed position that prevents fluid flow from the exterior of the housing through the housing.

4. A shut in tool as in claim 3 further comprising an actuation system for actuating the main valve between the loaded open position and the closed position and wherein the actuation system triggers movement of the main valve from the loaded open position to the closed position and further actuates the pressure relief valve between the relief valve open and relief valve closed positions.

5. A shut-in tool as in claim 4 wherein the actuation system includes a linearly-displaceable pull rod within the housing to effect opening of the main valve.

6. A shut-in tool as in claim 5 wherein the pull rod further effects triggering of the main valve to the closed position.

7. A shut-in tool as in claim 5 wherein the pull rod further effects opening and closing of the relief valve.

8. A shut-in tool as in claim 5 further comprising a push tube for engagement with the ball and a collet for releasably securing the push tube in the loaded position with the main valve open.

9. A shut-in tool as in claim 8 wherein the push tube includes a centrally located stem for contacting the ball.

10. A shut in tool as in claim 9 wherein the push tube includes at least one lock orifice and a drive slot operatively connected to the pull rod and wherein linear movement of the pull rod with respect to the push tube in a first direction advances the push tube with respect to the collet to engage the collet with the at least one lock orifice for releasably securing the main valve in the loaded position.

11. A shut-in to as in claim 10 wherein linear movement of the pull rod in a second direction disengages the collet from the at least one lock orifice to effect immediate closure of the main valve.

12. A shut-in tool as in claim 4 wherein the pressure relief system includes a relief ball linearly displaceable within the housing between a relief sealing surface and the relief-valve open position and wherein the relief ball is biased towards the relief sealing surface.

13. A shut-in tool as in claim 12 wherein the actuation system includes a pull rod having first and second flat surfaces and first and second tapered surfaces and wherein the pressure relief system includes a relief valve stem biased against the first and second flat and first and second tapered surfaces.

14. A shut-in tool as in claim 13 wherein engagement of the relief valve stem against the first and second flat surfaces maintains the pressure relief valve in a closed position and wherein engagement of the relief valve stem against the first and second tapered surfaces maintains the pressure relief valve in the open position.

15. A shut-in tool as in claim 4 wherein the actuation system is operatively connected to a microprocessor for controlling the times of opening and dosing the main valve and pressure relief valve.

16. A shut-in tool as in claim 15 further comprising at least one pressure sensor operatively connected to the microprocessor and wherein the microprocessor controls the opening and closing of the main valve and pressure relief valve in response to down hole conditions.

17. A shut-in tool as in claim 16 wherein the microprocessor is responsive to pressure pulses from the surface for opening and closing the main valve and pressure relief valve.

18. A shut-in tool as in claim 5 wherein the pull rod is operatively connected to a linear actuation system and motor.

19. A shut in tool for setting and sealing within downhole tubing above a producing formation and for collecting data from the formation, comprising:

a housing having an interior and exterior;

a main valve assembly within the housing having a main valve, the main valve operable between a loaded open position allowing fluid flow from the exterior of the housing through the housing and a closed position that prevents fluid flow from the exterior of the housing through the housing wherein movement from the loaded open position to the closed position is immediate upon triggering, the main valve having a ball linearly displaceable within the housing between a sealing surface when in the closed position and the loaded open position and wherein the ball is biased towards the sealing surface;

a pressure relief valve within the housing, the pressure relief valve operable between a relief valve open position allowing fluid flow from the exterior of the housing through the housing and a relief valve closed position that prevents fluid flow from the exterior of the housing through the housing; and an actuation system for actuating the main valve assembly between the loaded open position and the closed position wherein the actuation system triggers movement of the main valve from the loaded open position to the closed position, the actuation system also for actuating the pressure relief valve between the relief valve open and relief valve closed positions.

* * * * *